United States Patent [19]

Simo

[11] 4,093,230

[45] * June 6, 1978

[54] ARROWHEAD

[75] Inventor: Miroslav Andrew Simo, Riverside, Ill.

[73] Assignee: New Archery Products Corp., Riverside, Ill.

[ * ] Notice: The portion of the term of this patent subsequent to Feb. 8, 1994, has been disclaimed.

[21] Appl. No.: 738,030

[22] Filed: Nov. 2, 1976

Related U.S. Application Data

[63] Continuation-in-part of Ser. No. 619,824, Oct. 6, 1975, Pat. No. 4,006,901.

[51] Int. Cl.[2] ..... F41B 5/02

[52] U.S. Cl. ..... 273/106.5 B; 30/151; 150/52 H; 224/2 R

[58] Field of Search ..... 273/106.5 B, 106.5 C, 273/106.5 R; 30/368, 151; 224/2 D, 2 R; 150/52 R, 52 F, 52 H; 124/23

[56] References Cited

U.S. PATENT DOCUMENTS

| | | | |
|---|---|---|---|
| 2,684,852 | 7/1954 | Romeka | 273/106.5 B |
| 2,816,765 | 12/1957 | Stockfleth | 273/106.5 B |
| 2,940,758 | 6/1960 | Richter | 273/106.5 B |
| 3,618,948 | 11/1971 | McGlocklin | 273/106.5 B |
| 3,672,677 | 6/1972 | Moore | 273/106.5 B X |
| 3,741,542 | 6/1973 | Karbo | 273/106.5 B |
| 3,756,600 | 9/1973 | Maleski | 273/106.5 B |
| 3,910,579 | 10/1975 | Sprandel | 273/106.5 B |
| 3,915,455 | 10/1975 | Savora | 273/106.5 B |
| 4,006,901 | 2/1977 | Simo | 273/106.5 B |

OTHER PUBLICATIONS

Archery Magazine, p. 25, 10–1972 Broadhead Protection.

*Primary Examiner*—Paul E. Shapiro
*Attorney, Agent, or Firm*—Thomas W. Speckman

[57] ABSTRACT

An arrowhead assembly having an adapter at the head end of an arrow shaft, an arrowhead body forming a hollow cylinder providing freely rotatable movement when the adapter shaft is inserted therein, multiple blades firmly mounted within the arrowhead body and having a shape exterior to the arrowhead body with high length to width ratio for good aerodynamic flight charcteristics and deep target penetration and a conical nosepiece fastening to the adapter shaft in fixed relation to the adapter shaft allowing freely rotatable movement of the arrowhead body and blades with respect to the nosepiece, adapter shaft and arrow shaft. The arrowhead of this invention affords ready exchangeability of the arrowhead body in which all of the blades are embedded. The front of the arrowhead body is tapered to fit within a tapered hollow portion of the noisepiece. A protective sheath and nosepiece wrench for assembly or disassembly is described.

34 Claims, 8 Drawing Figures

ARROWHEAD

CROSS REFERENCE TO RELATED APPLICATION

This application is a continuation-in-part of my copending application Ser. No. 619,824, filed Oct. 6, 1975, now U.S. Pat. No. 4,006,901.

This invention relates to an arrowhead which is useful for hunting and provides easy and safe exchange of multiple blade arrowhead body units having different numbers of blades and blade configurations and the choice of having the arrow shaft rotate or remain stationary relative to the blades during penetration of a target.

A number of attempts have been made to provide arrowheads with replaceable cutting blades, but these have been entirely satisfactory. For example, the arrow tip disclosed in U.S. Pat. No. 3,756,600 shows the use of razor blades held in grooves of an arrow tip by a snap ring. However, this design if not entirely satisfactory since it is dangerous, difficult and time consuming to replace the blades and the shape of the blades provides a barb at the rear end which renders them unlawful for use in many states. Further, the arrowhead of the U.S. Pat. No. 3,756,600 patent is fixed with respect to rotation of the arrow shaft and this fixed relation greatly reduces forward penetration energy. Other attempts to solve the problem of providing readily replaceable blades to arrowheads are illustrated in U.S. Pat. Nos. 3,741,542, 3,854,723 and 2,940,758. The arrowheads as taught by each of these patents have the disadvantage of blades being individually mounted which makes them dangerous and difficult to readily exchange, particularly in the field under hunting conditons which includes the hunter standing on a treestand 10 to 20 ft. off the ground. Rotating arrow tips are also known to the art as disclosed in U.S. Pat. No. 3,527,463, however, arrow tips such as disclosed in that patent are not readily exchangeable, present difficulty in alignment of the arrowhead with the arrow shaft and do not provide for rotation of the blades relative to the tip portion. The entire arrowhead of the present invention rotates with the arrow shaft while in flight, but upon initial penetration of a target material, the blade portion ceases to rotate relative to the arrow shaft and nosepiece which creates a longer transition time for the arrow shaft to go from the spin phase to the no spin phase. This longer and smoother transition time lessens removal of forward penetration energy from the arrow so that a greater quantity of the arrow's energy is available for forward penetration into the target material. Further, the rotating blade portion allows the arrow to seek a path of least resistance through the target by slight rotation of the blade portion.

It is an object of this invention to overcome the disadvantages of prior arrowheads.

It is an object of this invention to provide a readily removable arrowhead affording good alignment with the arrow shaft and easy means for securement of the arrowhead to the arrow shaft.

It is another object of this invention to provide an arrowhead having a readily exchangeable arrowhead body in which all of the blades are embedded as a unit.

It is yet another object of this invention to provide a readily removable arrowhead wherein the arrowhead body including all of the blades can be adjusted to rotate or to remain stationary with respect to the arrow shaft and nosepiece, as described.

It is yet another object of this invention to provide an arrowhead wherein the length to width ratio is large resulting in greater penetration of the target material.

It is another object of this invention to provide a hunting arrowhead having the same weight as a target arrow tip.

It is still another object of this invention to provide a readily exchangeable arrowhead body including all of the blades wherein the blades do not have a barb effect upon penetration.

It is yet another object of this invention to provide a smoothly streamlined arrowhead which may have 2 to 7 blades, the larger number of blades reducing the width of the blades, minimizing aerodynamic steering and noise while increasing penetration of a target.

It is another object of this invention to provide improved impact resistance to the plastic arrowhead body.

It is still another object of this invention to provide an arrowhead protective sheath for handling, assembly and disassembly of the arrowhead using a safety wrench to tighten or loosen the nosepiece.

These and other features and advantages of this invention will become apparent from consideration of the description when taken in conjunction with the drawing showing preferred embodiments of this invention wherein.

Figure 1:
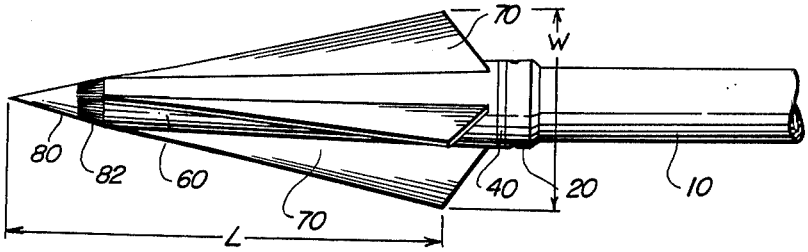
FIG. 1 is a side view of an arrowhead incorporating principles of this invention in the assembled position on an arrow shaft.

The arrowhead of this invention has three principal components shown in the drawings as nosepiece 80, arrowhead body 60 carrying blades 70 and adapter 20 for securing the arrowhead assembly to arrow shaft 10. Body spacer 40 is used when it is desired that arrowhead body 60 carrying blades 70 not rotate with respect to arrow shaft 10 and nosepiece 80 upon penetration of a target.

Figure 2:
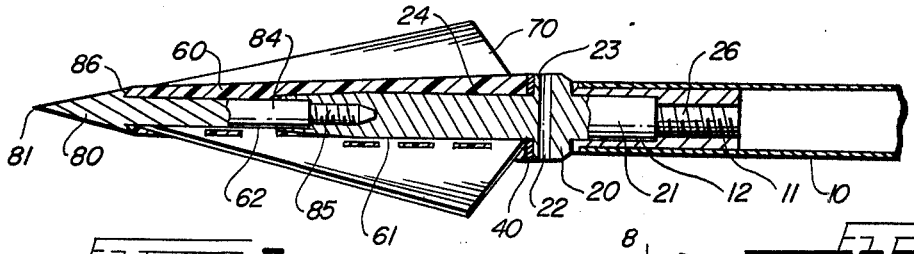
FIG. 2 is a partial cross-sectional assembled view of the arrowhead shown in FIG. 1.
Figure 3:
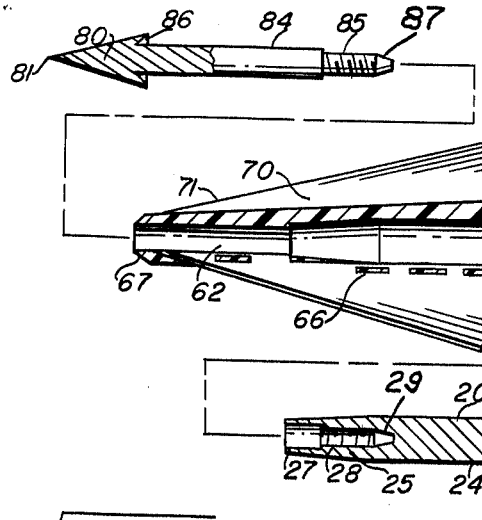
FIG. 3 is a disassembled view of the components of the arrowhead shown in FIGS. 1 and 2.

In assembling the arrowhead of this invention, adapter 20 is first tightened into aligned relationship with arrow shaft 10. Adapter 20 has arrow shaft extension portion 23 which may be approximately the same shape and diameter as the end of arrow shaft 10. Adjacent to arrow shaft extension portion 23 is adapter shaft 21 of smaller diameter and providing snug fitting relationship with adapter shaft receiving cylinder 12 in the end of arrow shaft 10. At the end of adapter 20 received within arrow shaft 10 is adapter threaded shaft 26 which is received in threaded relationship by matching thread receiving cylinder 11 in shaft 10. Thus, adapter 20 may be tightened in rigid aligned position with respect to arrow shaft 10 by fully tightening the screw threads of adapter threaded shaft 26, thereby obtaining a tight, adjacent shoulder relationship with the shoulders between adapter threaded shaft 26 and adapter shaft 21 and between adapter shaft 21 and arrow shaft extension portion 23. Tightening of adapter 20 may be facilitated by insertion of a stiff piece or wire or other material through tightening hole 22 to serve as a handle for the tightening action. Adapter 20 has adapter shaft 24 of suitable length and diameter to loosely fit within adapter shaft cylinder 61 of arrowhead body 60. Adapter shaft 24 may extend to the forward end of arrowhead body 60 or extend partially through arrowhead body 60 as shown in FIGS. 1–3. Adapter shaft 24 or adapter shaft cylinder 61 may have a friction ring or other suitable shape protruding from the surface to create sufficient friction to prevent rotation while passing through the air. The looseness of this fit should not permit undesired wobble to rattle but should permit easy rotation of arrowhead body 60 around adapter shaft 24 upon penetration of an object. The forward end of adapter shaft 24 has a nosepiece receiving cylinder with threaded portion 25 matching the threads of nosepiece threaded shaft 85 and smooth portion 28. The smooth portion provides greater strength to nosepiece shaft 84. It is preferred that the forward end of adapter shaft 24 have tapered portion 27 to provide greater length to smooth portion 28 of the nosepiece receiving cylinder while providing maximum thickness to arrowhead body 60.

Figure 7:
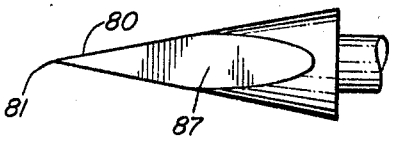
FIG. 7 is a side view of a nosepiece of one embodiment of this invention.

It must be appreciated that the essential feature of adapter 20 is the provision of adapter shaft 24 and nosepiece threaded receiving cylinder 25. It is within this invention that adapter shaft 24 and nosepiece threaded receiving cylinder 25 be provided by shaping the end of arrow shaft 10, thus not requiring a separate adapter 20. In this embodiment the nosepiece is screwed into the shaped forward end of the arrow shaft. This is shown in FIG. 7 of my allowed application Ser. No. 619,824, now U.S. Pat. No. 4,006,901 the disclosure of which is incorporated herein by reference in its entirety. Likewise, when wooden arrow shafts are used, an adapter providing adapter shaft 24 and nosepiece receiving cylinder 25 may be glued over the end of the wooden shaft. As shown in FIGS. 1 and 2, arrow shaft 10 is a hollow aluminum or fiberglass shaft with an adapter plug fastened in the end of the shaft to receive adapter shaft 21 and adapter threads 26. Arrow shaft extension portion 23, although shown in the figures as the same diameter as arrow shaft 10, may be either larger or smaller in diameter.

Arrowhead body 60 carries the desired number of blades 70 firmly embedded within arrowhead body 60. Two to about 7 blades are suitable dependent upon the purpose of the arrowhead. Blades 70 may be of any desired shape having straight, concave or convex leading edges. It is desired that the trailing edge of the blades not have a barb, but present easy withdrawal from a target. Sharpened trailing edge 72 provides for easy removal of the arrowhead after penetration into a body. The shape of blades 70 as shown in the figures is particularly preferred since it affords a continuously streamlined shape minimizing the overall diameter of the arrowhead when multiple blades, such as five, are used. Further, the smaller diameter reduces aerodynamic steering and eliminates the necessity for weight reduction cutouts in the blades which create a noise problem and increase penetration friction. It is desired that the penetration ratio, defined as L/W as shown in FIG. 1, be greater than 2.0 and preferably greater than 2.25. The higher penetration ratio permits deeper target penetration. The greater number blades made practical by use of the design of this invention makes it practical to increase the penetration ratio. I do not know of hunting arrowheads presently marketed having a penetration ratio of 2 or greater. Most hunting arrowheads presently marketed have a penetration ratio of about 1.2 to about 1.9.

To hold the blades firmly in arrowhead body 60 the blades preferably have cutout portions which may be holes or notches of any shape where they are embedded within arrowhead body 60 so that the moldable arrowhead body material flows through the openings providing for rigid securement of each blade to the arrowhead body. One preferred embodiment is shown in FIGS. 2 and 3 wherein the blades extend through the arrowhead body 60 to the surface of adapter shaft cylinder 61 and nosepiece shaft cylinder 62. When the blades extend to the shaft cylinders, penetration forces imparted to the leading edges of the blades is transferred directly to the adapter shaft 24 and nosepiece shaft 84. The blades also have openings 66 therethrough to permit the arrowhead body material, upon molding body 60, to flow through and embed each blade firmly within arrowhead body 60.

When the front of arrowhead body 60 is flat, as shown in application Ser. No. 619,824, now U.S. Pat. No. 4,006,901, I have found that during severe destructive testing of shooting the arrowhead into a brick, the front portion of the plastic arrowhead body 60 may crack on occasion. While this does affect the arrowhead in normal use, it is preferred that the arrowhead be able to strike a rock, as may occur during hunting, without suffering any damage. It is preferred that the forward end of arrowhead body 60 have tapered portion 67 to fit a matching tapered portion 86 within nosepiece 80. I have found that with tapered portion 67 the arrowhead can be shot into a brick along a line perpendicular to its surface without damage to the front portion of a plastic arrowhead body 60.

Figure 8:
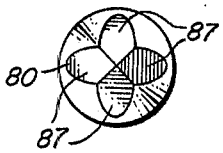
FIG. 8 is a sectional view of the nosepiece shown in FIG. 7.

Nosepiece 80 holds arrowhead body 60 in place upon adapter 20. Nosepiece 80 has nosepiece shaft 84 terminating in nosepiece threaded shaft 85 for screwable insertion into matching threaded portion 25 of nosepiece receiving cylinder in adapter shaft 24. It is preferred that nosepiece shaft 84 be smaller in diameter for its full length than adapter shaft 24 to provide for thicker arrowhead body 60 to more securely hold the forward ends of blades 70. Nosepiece 80 has hollow tapered portion 86 to receive tapered portion 67 of arrowhead body 60. Nosepiece 80 may have conical point 81 upon which serrations 82 may be provided toward the larger end as shown in FIG. 1. Nosepiece 80 may have a tapered point of polygonal cross section having flats 87 shows in FIGS. 7 and 8, preferably having 3 to 8 sides becoming round at both its point and its rearward cross section adjacent the front of body 60. Point 81 may be sharpened and of a hardened material, such as steel, to facilitate deeper penetration upon striking an object or may be slightly blunt to prevent curling upon striking a hard object. Serrations 82 may also be of a sharpened knife-like configuration to facilitate entry of the arrowhead point into an object. Nosepiece shaft 84 and nosepiece shaft cylinder 62 are sized so as to permit rotation of arrowhead body 60 on nosepiece shaft 84. The length of nosepiece shaft 84 is adjusted so that arrowhead body 60 rotates freely on shaft 84 with small clearance between tapered end 67 and hollow taper 86. It is preferred that the threads not extend to the end of nosepiece threads shaft 85 and matching thread cylinder 25 in adapter 20 and that the end of shaft 85 be of truncated cone shape 87 to fit firmly against tapered walls 29 in cylinder 25. When the end of shaft 85 firmly engages the bottom of cylinder 25 in the above manner, the thrust and bending imparted by striking a target is transmitted from nosepiece 80 to adapter 20 to arrow shaft 10. The resistance to bending is also improved by nosepiece receiving cylinder smooth portion 28.

As described above, arrowhead body 60 may be freely rotatable with respect to arrow shaft 10 and nosepiece 80. If it is desired to prevent the rotation of arrowhead body 60, body spacer 40 having hole 41 loosely fitting over adapter shaft 24. Body spacer 40 may be inserted over adapter shaft 24 between arrowhead body 60 and arrow shaft extension portion 23 so that when nosepiece 80 is tightened arrowhead body 60 is held firmly and in non-rotatable relation with arrow shaft 10 and nosepiece 80.

While the above description has referred to threaded fastening means for assembling the nosepiece, adapter and arrow shaft, it is recognized that any suitable fastening means may be used. For example, bayonet or O-ring and groove fastening means may be used. The terminology fastening means is meant to include all appropriate fastening methods for assembling the nosepiece to the adapter and arrow shaft.

The components of the arrowhead of this invention may be fabricated from any suitable materials. It is preferred that the nosepiece be fabricated from hardened steel. In order to minimize weight of the arrowhead assembly, it is preferred that the adapter be fabricated from aluminum, titanium, magnesium and alloys or other lightweight metal alloy. It is preferred that the nosepiece and adapter be metal since they must resist both thrust and bending forces when the arrowhead strikes a target. The blades are most suitably fabricated from steel or steel alloys which will take and maintain the desired sharpened edge. The arrowhead body is suitably fabricated from any suitable weight, high impact resistant moldable material. Synthetic polymeric materials such as nylon, polyethylene, polystyrene, polycarbonate, polyacetal, polysulfone, polyphenyleneoxide, polyesters and the like are suitable. The synthetic polymeric materials may be reinforced by any method known to the art, such as incorporation of fibers, such as fiberglass. Also suitable are moldable metals or metals suitable for forming into moldable shape by powdered metallurgical processes. Suitable metals include aluminum, titanium, magnesium and their alloys or other lightweight metal or alloy. The materials of construction may be selected so that the arrow and arrowhead assembly have a similar weight distribution as a target arrow and thus, the shooter does not have to allow for different arrow trajectory when he switches from target points to the arrowhead of this invention.

As can be readily seen from the above description, a wide variety of arrowhead bodies carrying different configurations and numbers of blades may be interchanged using the same arrow shaft adapter and nosepiece. Thus, the different arrowhead bodies may be marketed separately for interchange on an arrow shaft.

Figure 6:
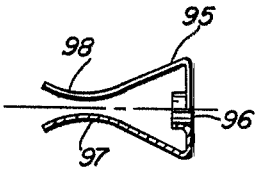
FIG. 6 is a side view of a safety wrench according to one embodiment of this invention for tightening or loosening the nosepiece.

FIG. 6 shows safety wrench 95 having serrations or polygonal shape hole 96 which mesh with serrations 82 or the polygonal cross section of nosepiece 80. Wrench 95 has concave opposing sides 97 and 98 for grasping between the thumb and a finger in a fashion so that the thumb and finger will not slip onto the blades when pressure is applied to engage the nosepiece. Wrench 95 is useful in tightening and loosening nosepiece 80 with respect to adapter 20. Nosepiece 80 may have other suitable engagement means such as a hole similar to tightening hole 22 for tightening and loosening the nose.

Figure 4:
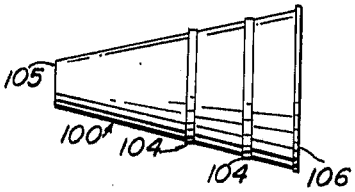
FIG. 4 is a side view of a protective sheath according to one embodiment of this invention.
Figure 5:
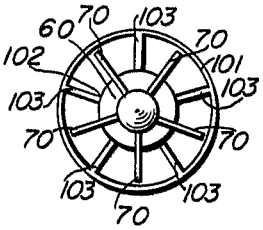
FIG. 5 is a cross-sectional view of the sheath shown in FIG. 4 in place on the arrowhead shown in FIG. 2.

A plastic sheath may be fabricated to cover the exposed blade portions when handling or storing the arrowhead body. A sheath of semi-rigid plastic wherein the front portion of the arrowhead body is exposed, may serve for safe handling of the arrowhead body with its blades upon assembly of the arrowhead. A preferred embodiment of a protective sheath is shown in FIGS. 4 and 5. Sheath 100 has exterior wall 101 the shape of truncated cone having large end 106 which when in place extends rearwardly beyond blades 70 and small end 105 which when in place extends forwardly beyond blades 70. Fins 103 extend inwardly from exterior wall 101 for a distance so that their ends 102 rest snugly upon arrowhead body 60. Exterior wall 101 is preferably of a diameter such that when fin ends 102 rest upon arrowhead body 60 blades 70 do not touch exterior wall 101. The number of fins 103 is not critical, but with three and more blades, it is preferable to locate a fin 103 between each adjacent blade 70. When the arrowhead has only two blades it is desirable to have two fins between adjacent blades. It is preferred to have multiple ribs 104 on the exterior of wall 101. Ribs 104 provide additional rigidity to the sheath and provide gripping for removal of the sheath from the arrowhead. The protective sheath may be slid over the forward end of the arrowhead body and is retained in position by the multiple fins engaging arrowhead body 60. The sheath may be kept in position affording protection from the blades both when the arrowhead is in position on the arrow shaft and when the arrowhead body carrying the blades is being handled separately and when the arrowhead is being assembled or disassembled. The protective sheath may be manufactured from the moldable plastics set forth above.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrowhead assembly for attachment to the head end of an arrow shaft comprising:

an adapter shaft having a head end and an other end, said other end having fastening means for securement to said head end of an arrow shaft and means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder, multiple blades firmly mounted within said body and having a shape exterior to said arrowhead body adapted for good aerodynamic flight characteristics and deep target penetration, the forward end of said arrowhead body having forwardly reducing diameter taper; and a tapered nosepiece having a fastening means at its tail end for mating with said fastening means in the head end of the adapter shaft fastening said nosepiece in fixed relation to said adapter shaft and said arrow shaft, said nosepiece having a hollow taper portion to receive said tapered forward end of said arrowhead body while allowing freely rotatable movement of said arrowhead body and blades.

2. The arrowhead assembly of claim 1 wherein said adapter shaft is at the head end of a separate adapter piece, said adapter shaft having fastening means in the other end thereof to firmly hold said adapter shaft in aligned position at the head end of said adapter piece.

3. The arrowhead assembly of claim 1 wherein said fastening means are threaded and said adapter shaft has a tightening hole therethrough for insertion of a tightening handle for tightening said adapter shaft upon said arrow shaft.

4. The arrowhead assembly of claim 1 wherein said arrowhead body is a high impact moldable plastic.

5. The arrowhead assembly of claim 4 wherein said blades have cutout portions so that the moldable plastic flows through the openings providing rigid securement to the arrowhead body and said blades extend through said arrowhead body to said hollow cylinder.

6. The arrowhead assembly of claim 1 wherein said arrowhead body has 2 to about 7 blades firmly mounted therein.

7. The arrowhead assembly of claim 6 wherein the arrowhead body has 5 blades firmly mounted therein.

8. The arrowhead assembly of claim 6 wherein said blades have straight leading edges increasing exposed blade depth from the head end of said arrowhead body and straight trailing edges decreasing exposed blade depth toward the other end of said arrowhead body.

9. The arrowhead assembly of claim 1 wherein said nosepiece is conical having serrations along at least a portion of its tapering surface.

10. The arrowhead assembly of claim 1 wherein said nosepiece has a tapered point of polygonal cross section having 3 to 8 sides.

11. The arrowhead assembly of claim 1 wherein said nosepiece when fastened to said adapter shaft firmly engages the adapter shaft so that the thrust and bending imparted upon striking a target is transmitted from the nosepiece to the adapter.

12. The arrowhead assembly of claim 11 wherein said nosepiece has a threaded shaft at the tail end thereof for engagement with a threaded cylinder in the head end of said adapter shaft, the end of said nosepiece threaded shaft and the bottom of said threaded cylinder having matching truncated conical shape for firm engagement to transmit the thrust and bending imparted upon striking a target from the nosepiece to the adapter to the arrow shaft.

13. The arrow head assembly of claim 1 wherein said nosepiece has a threaded shaft at its tail end, the nosepiece shaft having a smaller diameter than said adapter shaft, the forward end of said adapter shaft having a nosepiece receiving cylinder having a threaded portion for receiving said threaded nosepiece shaft at its rearward end and said cylinder having a smooth portion for receiving nosepiece shaft forward of the threads providing greater strength to said nosepiece shaft.

14. The arrowhead assembly of claim 1 additionally having a spacer fitting over said adapter shaft and in firm contact with the rear of said arrowhead body when said nosepiece is tightened, said arrowhead body being held firmly and in non-rotatable relation with respect to said arrow shaft and nosepiece.

15. The arrowhead assembly of claim 1 wherein the blades extend through the arrowhead body to the inner surface thereof transferring at least a portion of the penetration forces imparted to the blades directly to the adapter shaft.

16. The arrowhead assembly of claim 1 wherein the penetration ratio is greater than 2.0.

17. The arrowhead assembly of claim 1 having a protective sheath covering the blades, said sheath comprising an exterior wall the shape of a truncated cone having a large end which when in place extends rearwardly beyond the blades and an opposite small end which when in place extends forwardly beyond the blades, multiple fins extending inwardly from said exterior wall for a distance so that the fin ends engage said arrowhead body.

18. The arrowhead assembly of claim 17 wherein said sheath exterior wall has ribs on its external surface providing rigidity and gripping for handling of the sheath.

19. The arrowhead assembly of claim 17 additionally having a safety wrench with concave opposing sides for grasping between the thumb and a finger and having a side at generally right angles to said opposing sides with a hole therein having serrations or polygonal shape on the sides of the hole for engagement with said nosepiece.

20. An arrowhead assembly comprising:

an arrow shaft having a head end, an adapter shaft having a head end and an other end, said adapter shaft provided by shaping said arrow shaft head end and having means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder, multiple blades firmly mounted within said body and having a shape exterior to said arrowhead body adapted for good aerodynamic flight characteristics and deep target penetration, the forward end of said arrowhead body having forwardly reducing diameter taper; and a tapered nosepiece having a fastening means at its tail end for mating with said fastening means in the head end of the adapter shaft fastening said nosepiece in fixed relation to said adapter shaft and said arrow shaft, said nosepiece having a hollow taper portion to receive said tapered forward end of said arrowhead body while allowing freely rotatable movement of said arrowhead body and blades.

21. The arrowhead assembly of claim 20 having a protective sheath covering the blades, said sheath comprising an exterior wall the shape of a truncated cone having a large end which when in place extends rearwardly beyond the blades and an opposite small end which when in place extends forwardly beyond the blades, multiple fins extending inwardly from said exterior wall for a distance so that the fin ends engage said arrowhead body.

22. The arrowhead assembly of claim 21 wherein said sheath exterior wall has ribs on its external surface providing rigidity and gripping for handling of the sheath.

23. The arrowhead assembly of claim 20 additionally having a safety wrench with concave opposing sides for grasping between the thumb and a finger and having a side at generally right angles to said opposing sides with a hole therein having serrations or polygonal shape on the sides of the hole for engagement with said nosepiece.

24. An arrowhead assembly for attachment to the head end of an arrow shaft comprising:

an adapter shaft having a head end and an other end, said other end having fastening means for securement to said head end of an arrow shaft and means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder, multiple blades firmly mounted within said body and having a shape exterior to said arrowhead body adapter for good aerodynamic flight characteristics and deep target penetration;

a tapered nosepiece having a fastening means at its tail end for mating with said fastening means in the head end of the adapter shaft fastening said nosepiece in fixed relation to said adapter shaft and said arrow shaft while allowing freely rotatable movement of said arrowhead body and blades; and a protective sheath covering the blades, said sheath comprising an exterior wall the shape of a truncated cone having a large end which when in place extends rearwardly beyond the blades and an opposite small end which when in place extends forwardly beyond the blades, multiple fins extending inwardly from said exterior wall for a distance so that the fin ends engage said arrowhead body.

25. The arrowhead assembly of claim 24 wherein said sheath exterior wall has ribs on its external surface providing rigidity and gripping for handling of the sheath.

26. The arrowhead assembly of claim 24 additionally having a safety wrench with concave opposing sides for grasping between the thumb and a finger and having a side at generally right angles to said opposing sides with a hole therein having serrations or polygonal on the sides of the hole for engagement with said nosepiece.

27. In an arrowhead assembly for attachment to the head end of an arrow shaft; an adapter having a head end and a tail end, said tail end having fastening means for securement to said head end of an arrow shaft and means for fastening a nosepiece at said adapter head end, and a tapered nosepiece having a fastening means at its tail end for mating with said fastening means in the head end of the adapter fastening said nosepiece in fixed relation to said adapter and said arrow shaft, said adapter head end having a shaft portion fitting within an arrowhead body in which blades are mounted.

28. In the arrowhead assembly of claim 27 wherein said adapter head end has a shaft with a threaded cylinder in the head end thereof and said nosepiece tail end has a shaft having threads at the tail end thereof for threaded engagement with said threaded cylinder in the head end of said adapter shaft, both said adapter shaft and said nosepiece shaft fitting within a hollow portion of said arrowhead body.

29. In the arrowhead assembly of claim 28 wherein said nosepiece shaft has a smaller diameter than said adapter shaft, the forward end of said adapter shaft having a nosepiece shaft receiving cylinder having a threaded portion at its rearward end for engaging said threaded nosepiece shaft and said cylinder having a smooth portion for receiving nosepiece shaft forward of the threads.

30. In the arrowhead assembly of claim 29 wherein the end of said nosepiece threaded shaft and the bottom of said threaded cylinder have a matching truncated conical shape for firm engagement to transmit the thrust and bending imparted upon striking a target from the nosepiece to the adapter to the arrow shaft.

31. In the arrowhead assembly of claim 27 wherein said tapered nosepiece firmly engages said adapter so that the thrust and bending imparted upon striking a target is transmitted from the nosepiece to the adapter to the arrow shaft.

32. In an arrowhead assembly for attachment to the head end of an arrow shaft; an adapter having a head end and a tail end, said tail end having fastening means for securement to said head end of an arrow shaft and means for fastening a nosepiece at said adapter head end, and a tapered nosepiece having a fastening means at its tail end for mating with said fastening means in the head end of the adapter fastening said nosepiece in fixed relation to said adapter and said arrow shaft, said nosepiece having a shaft portion fitting within an arrowhead body in which blades are mounted.

33. In the arrowhead assembly of claim 32 wherein said tapered nosepiece firmly engages said adapter so that the thrust and bending imparted upon striking a target is transmitted from the nosepiece to the adapter to the arrow shaft.

34. In the arrowhead assembly of claim 32 wherein said nosepiece has a threaded shaft at the tail end thereof for threaded engagement with a threaded cylinder in the head end of said adapter, said nosepiece shaft fitting within a hollow portion of said arrowhead body.

* * * * *